United States Patent [19]

Evans

[11] 4,205,490

[45] Jun. 3, 1980

[54] VERTICALLY SHIFTABLE BELT CLEANER

[75] Inventor: F. David Evans, Eugene, Oreg.

[73] Assignee: Kimwood Corporation, Cottage Grove, Oreg.

[21] Appl. No.: 915,897

[22] Filed: Jun. 15, 1978

[51] Int. Cl.[2] ..... B24B 21/00

[52] U.S. Cl. ..... 51/135 R; 51/273; 51/135 BT

[58] Field of Search ..... 51/135 R, 135 BT, 269, 51/273, 356; 98/115 VM

[56] References Cited

U.S. PATENT DOCUMENTS

| | | | |
|---|---|---|---|
| 760,834 | 5/1904 | Yarnell | 51/273 |
| 1,079,032 | 11/1913 | Solem | 144/252 R |
| 2,011,984 | 8/1935 | Rosenberger | 51/273 |
| 2,120,888 | 6/1935 | Eaddy | 144/252 R |
| 2,173,563 | 9/1939 | Osgood | 51/273 |
| 2,279,782 | 4/1942 | Fowler | 51/170 EB |
| 2,783,593 | 3/1957 | Hercik | 51/135 R |
| 3,491,488 | 1/1970 | Schaller et al. | 51/135 R |
| 3,552,067 | 1/1971 | Przygocki | 51/135 BT |
| 3,837,383 | 9/1974 | Ko | 51/273 |
| 3,872,627 | 3/1975 | Schuster | 51/135 R |
| 3,889,429 | 6/1975 | Zuercher | 51/135 R |
| 4,020,601 | 5/1977 | Gray | 51/134 R |

FOREIGN PATENT DOCUMENTS

| | | | |
|---|---|---|---|
| 921828 | 5/1947 | France | 51/273 |
| 1331089 | 5/1963 | France | 51/273 |

*Primary Examiner*—Harold D. Whitehead
*Assistant Examiner*—K. Bradford Adolphson
*Attorney, Agent, or Firm*—Kolisch, Hartwell, Dickinson & Stuart

[57] ABSTRACT

A belt abrading device including a pair of laterally spaced rollers over which an elongate endless abrasive belt is trained. One of the rollers is mounted for shifting toward and away from the other. An exhaust hood is disposed adjacent the movable roller for shifting toward and away from the roller and the belt trained thereover. The exhaust hood is mounted on a lever arm which is operatively connected to a motor for shifting the hood toward and away from the roller. A sensor is provided for sensing continuity of the belt. Under usual operating conditions, the motor maintains the exhaust hood a preselected distance from the roller. Should the belt break and the sensor sense such discontinuity, or when desired by the operator, the motor is operated to shift the hood away from the roller.

7 Claims, 2 Drawing Figures

VERTICALLY SHIFTABLE BELT CLEANER

BACKGROUND AND SUMMARY OF THE INVENTION

This invention relates generally to a belt abrading device, and more particularly to an exhaust hood for such a device which is mounted for shifting toward and away from the belt under power.

Belt-type abrading machines are known. Such generally include an elongate, endless abrading belt which is trained over a pair of laterally spaced rollers. One of such rollers generally is mounted for shifting toward and away from the other to facilitate replacing the belt, for taking up stretch which occurs in the belt after prolonged usage, and to provide canting of the roller to produce desired tracking of the belt as it is carried over the rollers.

Various styles of exhaust hoods and mountings for exhaust hoods also are known in the prior art. These include hoods as illustrated in U.S. Pat. No. 3,872,627 to Schuster wherein a hood is mounted for swinging about a pivot axis spaced from the roller and may be manually shifted away from the roller. Another swingably mounted hood portion is illustrateed in U.S. Pat. No. 3,889,429 issued to Zuercher.

A hood carried in a preselected position relative to one of the rollers about which an abrading belt is trained is shown in U.S. Pat. No. 760,834 to Yarnell.

Other patents of interest illustrating exhaust hoods are shown in U.S. Pat. Nos. 2,279,782 to Fowler, 3,837,383 to Ko, 1,079,032 to Solem, 2,011,984 to Rosenberger, and 2,120,888 to Eaddy.

None of the above noted prior art devices appear to provide powered means for shifting the hood toward and away from the abrading belt, as may be desirable for shifting the exhaust out of the way quickly should a belt break in the apparatus. Further, none of the others appear to provide means for positively holding the hood under pressure in a preselected position relative to the belt during operation, with the ability if needed to shift the hood under power, quickly away from belt.

A general object of the present invention is to provide the above set out features not found in the prior at noted above.

A more specific object is to provide in belt abrading apparatus novel mounting for an exhaust hood which is operable under power to hold the hood, under usual operating conditions, in a preselected position relative to the belt, and upon initiation of a predetermined occurance, to cause the hood to be moved under power quickly away from the abrading belt.

A further object of the present invention is to provide such a novel device in which means is provided for sensing continuity of the belt, and upon sensing discontinuity of the belt to actuate the system for shifting the hood quickly away from the belt.

Yet another object of the present invention is to provide novel control means operable to produce slow and controlled movement of the hood toward its usual operating position a preselected distance from the belt, but to produce substantially rapid movement of the hood in the opposite direction to shift it out of the way of the belt.

These and other objects and advantages of the present invention will be more fully apparent as the following description is read in conjunction with the drawings.

DRAWINGS

FIG. 1 is a side elevation view of belt abrading apparatus with an exhaust hood shiftably mounted thereon constructed in accordance with an embodiment of the invention, with portions broken away; and FIG. 2 is a fragmentary elevation view of the apparatus taken generally along the line 2—2 in FIG. 1.

DETAILED DESCRIPTION OF A PREFERRED EMBODIMENT OF THE INVENTION

Figure 1:
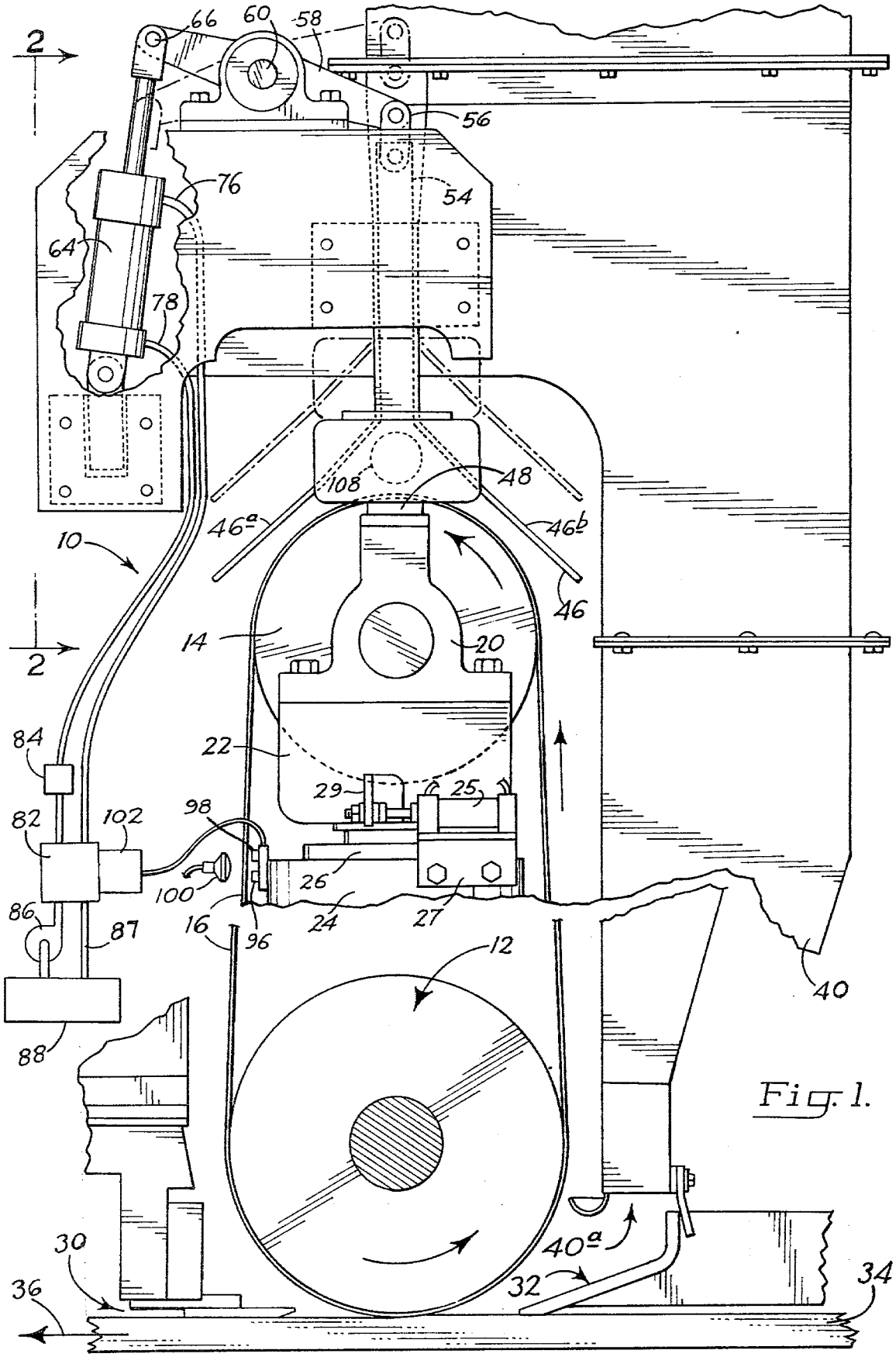

Referring first to FIG. 1, at 10 is indicated generally apparatus constructed according to an embodiment of the invention. It includes generally an elongate power driven lower roller 12 and an elongate freely rotatable upper roller 14 about which an elongate endless abrading belt 16 is trained. Rollers 12, 14 are mounted for rotation about laterally spaced, substantially parallel axes.

Figure 2:
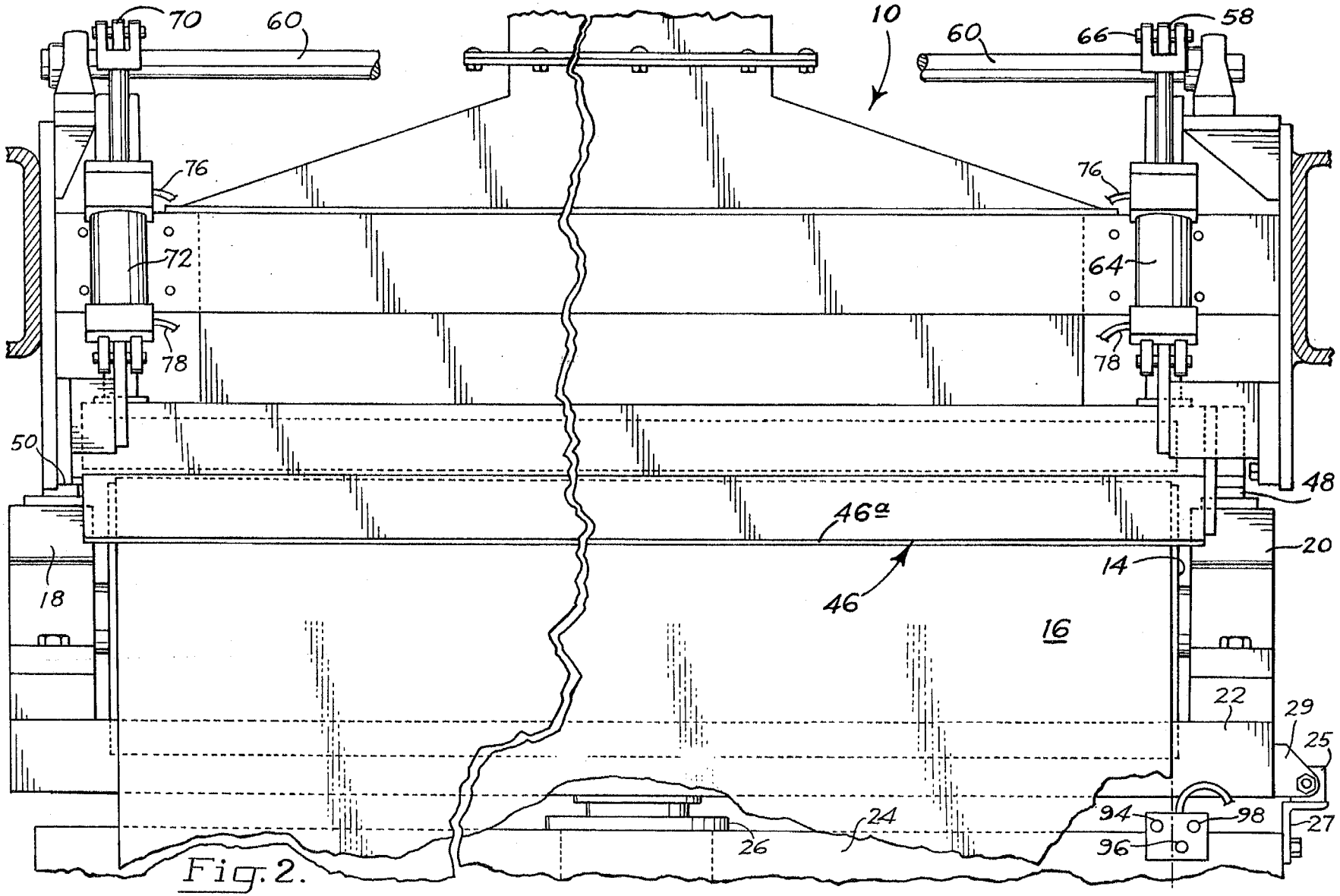

As is best seen in FIG. 2, the rollers, as illustrated for roller 14, are substantially constant diameter throughout their entire length, and thus do not have lips or shoulders at opposite ends to maintain belt 16 thereon. As is conventional, it is necessary to produce selected canting of at least one of the rollers to maintain the belt in proper position on the rollers.

Explaining further, if it is desired to cause belt 16 to shift either to the left or the right in FIG. 2 the rotational axis of roller 14 is canted to a position out of parallelism with the axis of roller 12. The direction of movement of the belt, either right or left, on roller 14 is determined by the direction of cant of the axis.

Roller 14 is rotatably mounted at its opposite ends in journal housings 18, 20 which are secured to opposite ends of an elongate mounting frame 22. Mounting frame 22, carrying journal housings 18, 20 and roller 14, is supported above a stationary frame member 24 in the apparatus by a vertically disposed hydraulic cylinder 26 which is recessed in frame member 24. As is best seen in FIG. 2, mounting frame 22 is secured adjacent its midsection to the extensible-contractible rod end of cylinder 26. Thus, extension of cylinder 26 serves to raise frame 22 and roller 14, and retraction serves to lower them. Roller 14 thus is shiftable vertically with respect to roller 12 through operation of cylinder 26, providing convenient means for adjusting the tension of belt 16, for compensating for stretching of the belt during use, or for releasing the belt for maintenance or change.

Means is also provided for adjusting the tracking of belt 16. This includes a horizontally disposed hydraulic cylinder 25 secured to mounting member 24 by an angle bracket 27. Secured to the outer end of mounting frame 22 is a lug, or bracket, 29. The rod end of cylinder 25 is operatively connected to lug 29, whereby upon extension or retraction of cylinder 25, force is applied to mounting frame 22 to cause roller 14 to pivot, or cant, in a horizontal plane about the axis of upright cylinder 26. By thus varying the angular relationship of rollers 12, 14 the tracking of belt 16 on the rollers can be adjusted.

At the lower end of the apparatus as seen in FIG. 1, hold down devices indicated generally at 30, 32 are illustrated on opposite sides of roller 12 to hold material, such as a board 34 against an underlying conveyor (not shown). The conveyor is operable to move board 34 to the left in the direction indicated by arrow 36.

During operation, as the board is moved to the left roller 12 and belt 16 trained thereover are turned in a counter-clockwise direction to abrade material from the upper surface of the board.

A vacuum exhaust sleeve 40 having an opening 40*a* adjacent roller 12 is operable to remove a portion of the dust and other particles produced during abrading and carry them upwardly through sleeve 40 to remove them from the work area.

A portion of the abraded material clings to the surface of belt 16 and is carried upwardly on the surface of the belt (on the right hand side of the belt as illustrated in FIG. 1) toward roller 14.

An inverted V-shaped exhaust hood 46 is mounted above roller 14 to received and carry away such material carried on the belt. As is seen in FIG. 1, hold 46 has opposed side portions 46*a*, 46*b*, which diverge on progressing downwardly toward roller 14. Adjacent the upper set of ends of side portions 46*a*, 46*b* they are spaced apart to provide a throat through which exhaust may be provided. Explaining further, the exhaust hood 46 communicates at its upper end with the same vacuum source which connects to exhaust sleeve 40 to carry materials away from the abrading belt.

At opposite ends of hood 46 are secured blocks 48, 50 which overlie journal housings 18, 20, respectively. In the normal, or usual, operating position blocks 48, 50 rest atop journal housings 18, 20 to maintain a preselected spacing between portions 46*a*, 46*b* and the upper surface of belt 16 as it travels over roller 14. Such spacing is illustrated in solid outline in FIG. 1.

The exhaust hood is mounted for vertical shifting between the position illustrated in solid outline in FIG. 1 and a raised positioned spaced a distance thereabove as illustrated in dot-dash outline in FIG. 1. The interconnection between hood 46 and the vacuum source is such that the hood is maintained in communication with the vacuum source throughout such vertical shifting, as through a sleeve connection.

Elongate upright arms adjacent opposite sides of the apparatus, such as that indicated generally at 54 in FIG. 1, are secured at their lower ends to hood 46. The arm visible in FIG. 1 is connected at its upper end through pivot link 56 to one end of an elongate lever arm 58. Lever arm 58 is pivotally mounted on an axle 60 for rocking about a horizontal axis paralleling the axes of rollers 12, 14.

An elongate extensible-contractible ram 64 is pivotally mounted at its cylinder end on frame structure of the apparatus and its rod end is pivotally connected at 66 to the end of lever arm 58 opposite its connection to link 56.

As is seen in FIG. 2, axle 60 extends across the upper end of the apparatus to mount another similar lever arm arrangement 70 adjacent the opposite end of the hood to support and operate the opposite end of the hood. This is operatively connected to another ram 72 at the opposite side of the apparatus.

Each of rams 64, 72 is similarly operatively connected to a source of fluid under pressure as will now be described for ram 64, as seen in FIG. 1.

A first conduit, or line, 76 is operatively connected to the upper ends of each of rams 64, 72 and a second conduit, or line, 78 is operatively connected to the lower ends of the rams. The opposite ends of lines 76 connect directly to a valve 82, while lines 78 connect to valve 82 through a flow regulator 84. Flow regulator 84 is such as to restrict the rate of fluid flow to the lower end of the ram.

Valve 82 is connected, through a return line 87 and a pump 86 to a reservoir of operating fluid 88.

With valve 82 in one operative mode, or position, fluid under pressure is provided through the valve and flow regulator to the lower ends of rams 64, 72, such that the rams are extended. This pivots the lever arms to lower, or hold, the exhaust hood in its usual working position illustrated in solid outline in FIG. 1. In this position blocks, or engaging members 48, 50 rest against their respective journal housings 18, 20.

In a second operating position, valve 82 is operable to supply pressure fluid to the upper ends of rams 64, 72 to retract the rams. This pivots the lever arms to raise the exhaust hood to the position illustrated in dot-dash outline. With flow regulator 84 in line 78, the downward shifting of the hood produced by extension of rams 64, 72 will be considerably slower and at a more controlled rate than that which occurs upon retraction of the rams to lift the hood to its raised position. The purpose for this will be explained more fully below.

In FIG. 2 are illustrated three laterally spaced photocells 94, 96, 98. Each of these is mounted adjacent the inner side of belt 16 as illustrated in FIG. 1. A light source 100 mounted outside of belt 16 is directed toward the photocells (see FIG. 1).

As is seen in FIG. 2, photocells 94, 96, 98 are mounted closely adjacent one edge of the belt. With the belt in the position illustrated in FIG. 2 photocell 94 is spaced laterally inwardly from the edge of the belt, and photocells 96, 98 are spaced laterally outwardly from the outer edge of the belt.

Photocell 96 is part of tracking means in the apparatus for maintaining the belt properly aligned on the rollers. Such tracking means is conventional and will be described here only in summary. Control mechanism for cylinder 25 actuates the cylinder to cause the belt to track, or shift, gradually to the right in FIG. 2 during operation. When the belt passes over photocell 96, thus to break the light beam from light source 100, control mechanism for cylinder 25 reverses operation of the cylinder, to cant roll 14 to a position where belt 16 begins tracking, or shifting, to the left in FIG. 2. A timer within the control mechanism permits the belt to travel to the left for a preselected period of time, after which cylinder 25 is actuated again to cant the roller 14 into a position to cause the belt to track again to the right. Thus, the belt cycles to the right and then to the left during operation to maintain it within a selected pair of outer limits on roller 14 during operation.

Referring to photocell 94, during normal operating conditions, light from source 100 is blocked by belt 16. Conversely, photocell 98 during normal operating conditions receives light from source 100. Each of these photocells is operatively connected to control mechanism for the apparatus, whereby should photocell 94 be exposed to light source 100, or photocell 98 be blocked from light source 100 by operation of the belt, the abrading apparatus will be immediately and automatically shut down.

Photocells 94, 98 are both also operatively connected to a valve control device 102 (see FIG. 1). This valve control device is, in turn, operatively connected to valve 82 for shifting the same between its first and second operating conditions. Control device 102 is so constructed, that when photocell 94 is blocked from light source 100, and photocell 98 receives light from source 100, the valve control device 102 will maintain valve 82 in its first operating position to maintain the exhaust hood in its lowered, operating position as seen in solid outline in FIG. 1. Should photocell 94 be exposed to light from source 100 (as by shifting of the belt too far to the left, or breakage of the belt), or should photocell 98 be blocked from light from source 100 by shifting of the belt too far to the right, valve control unit 102 is activated to shift valve 82 to its second operating position to quickly retract rams 64, 72 and raise the exhaust hood.

Thus, photocell 96 and the tracking control mechanism described in summary above, is operable under normal operating conditions to maintain the belt between preselected outer limits on the roller. Should the belt shift laterally to either side outside of these limits, this will be sensed by photocell 94 or 98 to immediately shut down the apparatus and quickly raise the exhaust hood. The apparatus is shut down and hood 46 is raised if a break in the belt is sensed by photocell 94.

Mounted within exhaust hood 46, between sides 46*a*, 46*b* is an elongate belt cleaner 108. This belt cleaner is operable to spray fluid at high pressure onto the belt as it travels upwardly over the righthand side of roller 14 as illustrated in FIG. 1, thus to dislodge materials which can then be drawn into the exhaust hood.

Describing operation of the device, should it be desired to remove or replace a belt, it is a simple matter to actuate rams 64, 72 in a retracting mode to raise hood 46 to the position illustrated in dot-dash outline in FIG. 1 to provide sufficient clearance for working on the belt. Once the belt has been properly positioned rams 64, 72 are extended, with such extension being controlled by flow regulator 84 to lower the hood slowly and evenly to the position illustrated in solid outline in FIG. 1. With the hood in this position, blocks 48, 50 ride slidably atop journal housings 18, 20 with substantially constant pressure being applied thereto by rams 64, 72. Should roller 14 be canted during operation, blocks 48, 50 remain resting slidably atop the journal housing to maintain a preselected distance between the roller 14 and hood 46.

Should the belt break, such discontinuity would be sensed by photocell 94. Valve control device 102 then is actuated to shift valve 82 to its second operating position to quickly retract rams 64, 72 to raise the hood out of the way of the belt.

While a preferred embodiment of the invention has been described herein, it should be apparent to those skilled in the art that variations and modifications are possible without departing from the spirit of the invention.

It is claimed and desired to secure by Letters Patent:

1. In combination with a flexible belt abrader including an endless belt having an abrasive material-removing outer face and a pair of spaced rollers over which said belt is trained, roller mounting means on which one of said rollers is mounted for shifting in one direction away from the other of said rollers and in another direction toward the other roller, an exhaust hood disposed adjacent said one roller and spaced outwardly in said one direction therefrom, for providing a suction adjacent such outer face, hood mounting means operatively connected to said hood including motor means operable in one operating mode to maintain said hood, under usual operating conditions, a preselected distance from said one roller and, in a second operating mode, to move said hood under power in said one direction away from said one roller, sensing means for sensing belt continuity, and control means operatively interconnecting said motor means and said sensing means to actuate said motor means to shift said hood away from said one roller upon said sensing means detecting discontinuity in said belt.

2. The combination of claim 1, wherein said hood mounting means comprises an elongate lever arm on which said hood is mounted and said motor means operatively connected to said lever for swinging the arm to move said hood toward or away from said one roller.

3. The combination of claim 2, wherein said motor means comprises an extensible-contractable fluid actuated ram which, on operation in one direction, shifts said hood toward said one roller and upon operation in the opposite direction moves said hood away from the one roller.

4. The combination of claim 3, wherein said control means comprises a valve operable to control the flow of actuating fluid to and from said ram and said sensing means comprises a photoelectric sensor.

5. The combination of claim 4, which further comprises first and second conduit members for supplying fluid under pressure to said ram, with supply to pressure fluid through the first causing the hood to move toward said one roller with the supply of pressure fluid through the second causing the hood to move away from said one roller, and said control means further comprises flow regulating means in said first conduit means operable to restrict the flow of actuating fluid therethrough for producing movement of said hood toward said one roller at a first speed, with relatively unrestricted flow occurring through said second conduit means to move the hood away from said one roller at a speed in excess of said one speed.

6. The combination of claim 1, wherein said roller mounting means comprises a journal housing in which said one roller is mounted for rotation and said hood mounting means comprises engaging means operable to engage a portion of said journal housing to establish a selected distance between said hood and roller, and said power actuated means under usual operating conditions urges said engaging means toward said journal housing.

7. The combination of claim 1, wherein said hood has opposed side portions which extend in the direction of said one roller and diverge on progressing toward the one roller to be positioned adjacent opposite sides of said one roller in usual operating positions, and said hood mounting means is operable to shift said hood in said one direction away from said one roller.

* * * * *

UNITED STATES PATENT AND TRADEMARK OFFICE

CERTIFICATE OF CORRECTION

PATENT NO. : 4,205,490

DATED : June 3, 1980

INVENTOR(S) : David F. Evans

It is certified that error appears in the above–identified patent and that said Letters Patent are hereby corrected as shown below:

In the claims:

Claim 5, column 6, line 34, after the word 'supply' delete "to" and add --of-- therefor.

Signed and Sealed this

*Seventh* Day of *October 1980*

[SEAL]

*Attest:*

SIDNEY A. DIAMOND

*Attesting Officer*

*Commissioner of Patents and Trademark*